US006808417B2

(12) United States Patent
Yoshida

(10) Patent No.: US 6,808,417 B2
(45) Date of Patent: Oct. 26, 2004

(54) COAXIAL CONNECTOR

(75) Inventor: Norihito Yoshida, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 54 days.

(21) Appl. No.: 10/379,595

(22) Filed: Mar. 6, 2003

(65) Prior Publication Data

US 2003/0224656 A1 Dec. 4, 2003

(30) Foreign Application Priority Data

Apr. 5, 2002 (JP) ..... 2002-104242

(51) Int. Cl.[7] ..... H01R 9/05
(52) U.S. Cl. ..... 439/585
(58) Field of Search ..... 439/585, 595, 439/752.5, 394, 610

(56) References Cited

U.S. PATENT DOCUMENTS 6,200,162 B1 * 3/2001 Aoyama et al. ..... 439/578
6,746,277 B2 * 6/2004 Laub et al. ..... 439/585

FOREIGN PATENT DOCUMENTS

JP A 2000-260540 9/2000

* cited by examiner

*Primary Examiner*—Lynn Feild
*Assistant Examiner*—Phuong Dinh
(74) *Attorney, Agent, or Firm*—Oliff & Berridge, PLC

(57) ABSTRACT

In a coaxial connector, when an inner conductor terminal connected to a signal conductor of a coaxial cable is inserted in and fixed to a dielectric member, which has been received in an outer conductor terminal in advance, by utilizing an upwardly-open space (opening portion) in the outer conductor terminal. A press-clamping portion serving as a connecting portion of the inner conductor terminal connected to the signal conductor is exposed in the opening portion. A matching convex wall is formed on an inner bottom surface of the opening portion to reduce the inner diameter of the opening portion toward the press-clamping portion, thereby matching the characteristic impedance of the connector also in the vicinity of the press-clamping portion. A shielding member closes the opening portion.

13 Claims, 10 Drawing Sheets

B-B SECTION VIEW

COAXIAL CONNECTOR

The present disclosure relates to the subject matter contained in Japanese Patent Application No.2002-104242 filed on Apr. 5, 2002, which is incorporated herein by reference in its entirety.

BACKGROUND OF THE INVENTION

1. Field of the Invention

This invention relates to a connector for connection to a cable having a shielding conductor such as a coaxial cable, and more particularly to a high-frequency connector, which achieves the characteristic impedance matching with a transmission path and can be easily mounted on and connected to a cable end.

2. Description of the Related Art

In recent years, electrical signals have been adapted to be transmitted at high speed (high frequency) to a control-purpose printed circuit board having electronic parts, ICs (Integrated Circuits) and the like contained in an automotive electrical equipment such as a car navigation system. In addition, circuit patterns on such a printed circuit board have been densely arranged to provide a high-density design. Generally, a coaxial cable is used for transmitting such a high-frequency electrical signal and with the higher-frequency transmission of the electrical signal, the connector for connection to this coaxial cable has been required to have a compact design meeting with the high-frequency transmission.

Referring to a common structure of a coaxial cable, the coaxial cable has a coaxial structure in which an insulator is interposed between a signal conductor (serving as a transmission path for an electrical signal or the like) including a plurality of metal wires twisted together into a bundle and a shielding conductor including a braided wire having a plurality of woven wires. The outer periphery of this structure is covered with an insulating sheath. The shielding conductor covers the outer peripheral surface of the signal conductor with a predetermined gap therebetween completely over the entire periphery thereof, so that this structure is suited for transmitting a high-frequency electrical signal.

Generally, a coaxial connector, which contains terminals and is connected to each of both ends of such a coaxial cable for transmitting a high-frequency signal, includes an inner conductor terminal, an outer conductor terminal, and a dielectric member. The inner conductor terminal is connected to the signal conductor of the cable. The outer conductor terminal is connected to the shielding conductor such as a braided wire and covers the outer periphery of the inner conductor terminal to electromagnetically shield the inner conductor terminal. The dielectric member having a predetermined dielectric constant is interposed between the inner conductor terminal and the outer conductor terminal. The inner conductor terminal and the outer conductor terminal are electrically connected separately respectively to the signal conductor and the shielding conductor, which are exposed at the cable end to be connected to the connector by removing the sheath and the insulator therefrom.

When the characteristic impedance of a coaxial cable for transmitting a high-frequency electrical signal does not coincide with the characteristic impedance of each of coaxial connectors connected to both ends of this cable, respectively, the reflection of the signal occurs. This reflection causes noises and besides the transfer of energy is wasted. Therefore, it is necessary to achieve the impedance matching between the coaxial connector and the coaxial cable usually by setting the impedance value, for example, to 50Ω. With respect to the characteristic impedance of the coaxial connector, generally, "a ratio of an inner diameter of a cross-section of the outer conductor terminal to an outer diameter of a cross-section of the inner conductor terminal" and "the dielectric constant of the dielectric member" are adjusted to achieve the impedance matching with a coaxial cable to be connected to the coaxial connector. If the inner conductor terminal within the coaxial connector has any portion, which is not covered with the outer conductor terminal, there is encountered a problem that the shielding performance such as radiation characteristics is lowered. Therefore, it is preferred that the inner conductor terminal should be covered with the outer conductor terminal completely over the entire periphery thereof.

One high-frequency coaxial connector is disclosed in JP-A-2000-260540. This connector is so designed that at a time of mounting the connector on the coaxial cable to connect the connector, cutting of the signal conductor of the coaxial cable and an eccentric arrangement of the inner conductor terminal of the connector with respect to the coaxial cable are prevented.

A process of mounting this coaxial connector on the coaxial cable includes the following steps: i) exposing the signal conductor and a shielding conductor over a predetermined length by peeling a sheath from an end portion of the coaxial cable; ii) press-fastening a press-clamping portion of the inner conductor terminal to the signal conductor; iii) inserting a separately-prepared sleeve between an insulator and the shielding conductor; iv) fitting an outer conductor terminal to the coaxial cable and attaching a dielectric member to the inner conductor terminal; v) subsequently returning the fitted outer conductor terminal to cause this outer conductor terminal to receive the dielectric member therein; and vi) finally press-fastening a press-clamping portion of the outer conductor terminal to the cable.

However, in the coaxial connector disclosed in the JP-A-2000-260540, an opening portion in a rear end of the outer conductor terminal is made large in order to prevent the signal conductor from being cut when returning the outer conductor terminal to cause it to receive the dielectric member attached to the inner conductor terminal. Therefore, the impedance matching with the coaxial cable and the shielding performance were not excellent.

Furthermore, the connector of this structure has a problem with the manner of mounting the connector on the cable. Namely, most of the above mounting steps must be carried out manually and the ratio of its production cost to its product price is higher as compared with those connectors mounted on the cable by a highly-automated process. Therefore it has been difficult to provide this connector at low costs.

SUMMARY OF THE INVENTION

An object of this invention is to provide a coaxial connector in which the impedance matching in the coaxial connector is achieved to reduce the noise radiation amount, the reflection loss of a signal and the like, and a process of mounting the connector on a cable end can be carried out efficiently.

To solve the above problems, there is provided a coaxial connector for a coaxial cable having a signal conductor, a shielding conductor, an insulator disposed between the signal conductor and the shielding conductor, and a sheath covering an outer periphery thereof. The coaxial connector includes an inner conductor terminal, a dielectric member, an outer conductor terminal, and a shielding member. The inner conductor terminal is connected to the signal conductor. The outer conductor terminal of a cylinder shape, receives the inner conductor terminal through the dielectric member. The outer conductor terminal is connected to the shielding conductor. The outer conductor terminal includes a first opening, a side wall, and a convex wall. The convex wall is formed at a position opposed to a connection portion between the exposed signal conductor and the inner conductor terminal, to project toward inside thereof. The shielding member is attached to the outer conductor terminal to close the first opening.

A sectional area of the first opening closed by the shielding member may be smaller than that of other portion of the outer conductor terminal.

The convex wall may be formed to reduce a sectional area of the first opening.

In the coaxial connector of the above construction, the cross-sectional area of the outer conductor terminal at a connecting portion where the signal conductor of the coaxial cable and the inner conductor terminal are connected together is reduced in accordance with the cross-sectional area of the signal conductor at the connecting portion, thereby achieving the impedance matching. The first opening is formed on the outer conductor terminal to receive the inner conductor terminal. The convex wall is formed to reduce a sectional area of the first opening. As a result, the characteristic impedance in the neighbor of the connecting portion between the signal conductor and the inner conductor terminal is reduced so that it is possible to match the impedance. In addition, the inner conductor terminal, which has already been connected to the signal conductor, can be inserted into the dielectric member, which is received inside the outer conductor terminal in advance, by utilizing the first opening of the outer conductor terminal. Therefore, the insertion of the inner conductor terminal by utilizing the first opening can be easily effected in an automated manner by the use of a machine. Namely, as compared with the coaxial connector according to the related art, which has been manually mounted on the cable, the production cost can be reduced. The shielding member may close the first opening. Therefore, the lowering of the shielding performance is small.

In this case, when the shielding member is attached in a position where the cross-sectional area of the first opening is reduced, the high characteristic impedance in the vicinity of the connecting portion between the inner conductor terminal and the signal conductor can also be decreased using the shielding member. Therefore, using this construction and the matching convex portion in combination, it becomes possible to adjust the characteristic impedance in the vicinity of the connecting portion between the inner conductor terminal and the signal conductor. Thus, this facilitates the design of the connector.

In addition, the shielding member may be attached to the outer conductor terminal to engage with the side wall of the first opening. With this construction, the shielding member can be mounted on the outer conductor terminal at other portion than a portion closing the opening portion. Therefore, the opening portion can be fully closed.

The outer conductor terminal may further integrally include a sleeve for covering the shield conductor of the coaxial cable. The shielding member may include a press-clamping portion, which is press-fixed to a portion of the sleeve, which the shielding conductor covers. With this construction, it is not necessary to separately provide a sleeve for preventing the deformation of the cable as described above in the "Background of the invention". This prevents the number of the component parts of the connector from increasing. Thus, the press-clamping portion for clamping engagement with the cable, which is formed integrally on the outer conductor terminal in the related art, is eliminated. This portion is formed into the sleeve portion for preventing the deformation of the cable. Instead, the press-clamping portion for clamping engagement with the cable is formed on the shielding member. With this construction, the process of mounting the connector on the cable can be carried out in an automated manner by a machine. Namely, the production cost required for mounting the connector on the coaxial cable can be reduced as compared with the related art in which manual assembly is conducted.

The coaxial connector may further include a connector housing. The shielding member may include a stabilizer serving as a guide when the connector housing is attached. Alternatively, the shielding member may include a stabilizer protruding therefrom outwardly. With either construction, it is not necessary to provide a stabilizer on the outer conductor terminal. Therefore, the outer conductor terminal is prevented from being formed into a complicated shape. In addition, the coaxial connector may further include a connector housing having a retainer. The shielding member may include a stabilizer for engaging with the retainer. With this construction, the detachment of the connector from the connector housing is prevented. Furthermore, the coaxial connector may further include a connector housing having a lance for engaging with a second opening portion formed by protruding the convex wall. With this construction, the detachment of the coaxial connector from the connector housing is prevented. Also, when the connector is retained within the connector housing by the double-retaining function provided by the lance and the retainer, the coaxial connector is prevented from being wrenched within the connector housing, and damage of the connector is prevented.

According to another aspect of the invention, there is provided a coaxial connector for a coaxial cable having a signal conductor, a shielding conductor, a insulator disposed between the signal conductor and the shielding conductor, and a sheath covering an outer periphery thereof. The coaxial connector includes first and second connectors. The first connector includes an inner conductor terminal, a dielectric member, an outer conductor terminal, and a shielding member. The inner conductor terminal of a female terminal shape, is connected to the signal conductor. The outer conductor terminal of a cylinder shape, receives the inner conductor terminal through the dielectric member. The outer conductor terminal is connected to the shielding conductor. The second connector includes an inner conductor terminal and an outer conductor terminal. The inner conductor terminal of a male terminal shape, is connected to the inner conductor terminal of the first connector. The outer conductor terminal of the first connector includes an opening, a side wall, and a convex wall. The convex wall is formed at a position opposed to a connection portion between the exposed signal conductor and the inner conductor terminal, to project toward inside thereof. The shielding member of the first connector is attached to the outer conductor terminal of the first connector to close the opening portion of the first connector. The end portion of the dielectric member of the first connector has smaller diameter than an end portion of the outer conductor terminal of the second connector. An air layer is defined between the dielectric member of the first connector and the outer conductor terminal of the second connector when the first and second connectors are connected to each other. With this construction, the disturbance of the characteristic impedance can be eliminated also at a region where the first and second connectors are connected.

In this case, a rib extending in a longitudinal direction may be formed on the dielectric member of the first connector. With this construction, the strength of the dielectric member is increased. In addition, a guide surface of a tapered shape may be formed on the end portion of the dielectric member of the first connector. With this construction, the smooth fitting operation can be effected.

DETAILED DESCRIPTION OF THE PREFERRED EMBODIMENTS

Figure 1:
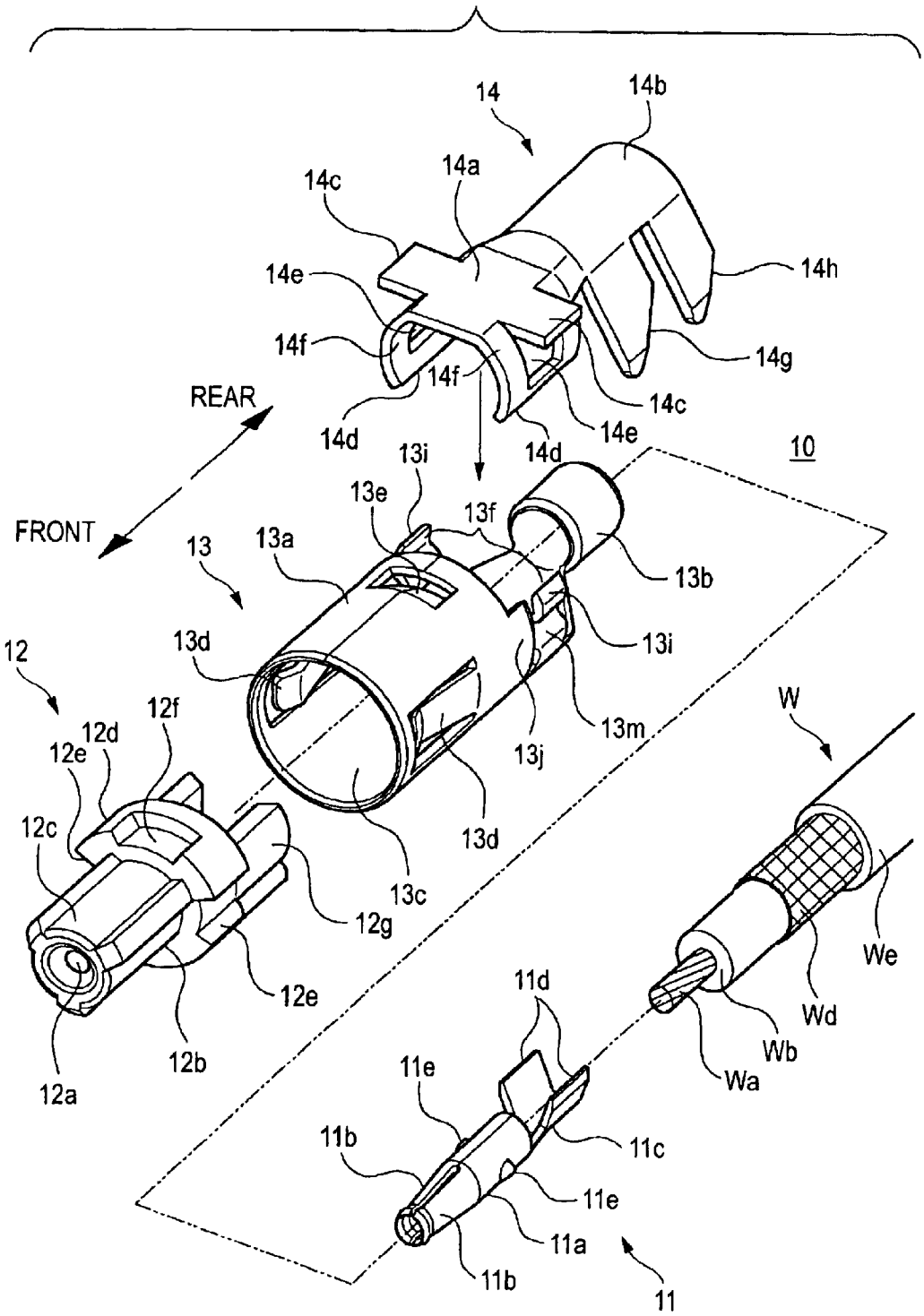
FIG. 1 is an exploded, perspective view of one preferred embodiment of a coaxial connector of the present invention as viewed from the front side.
Figure 2:
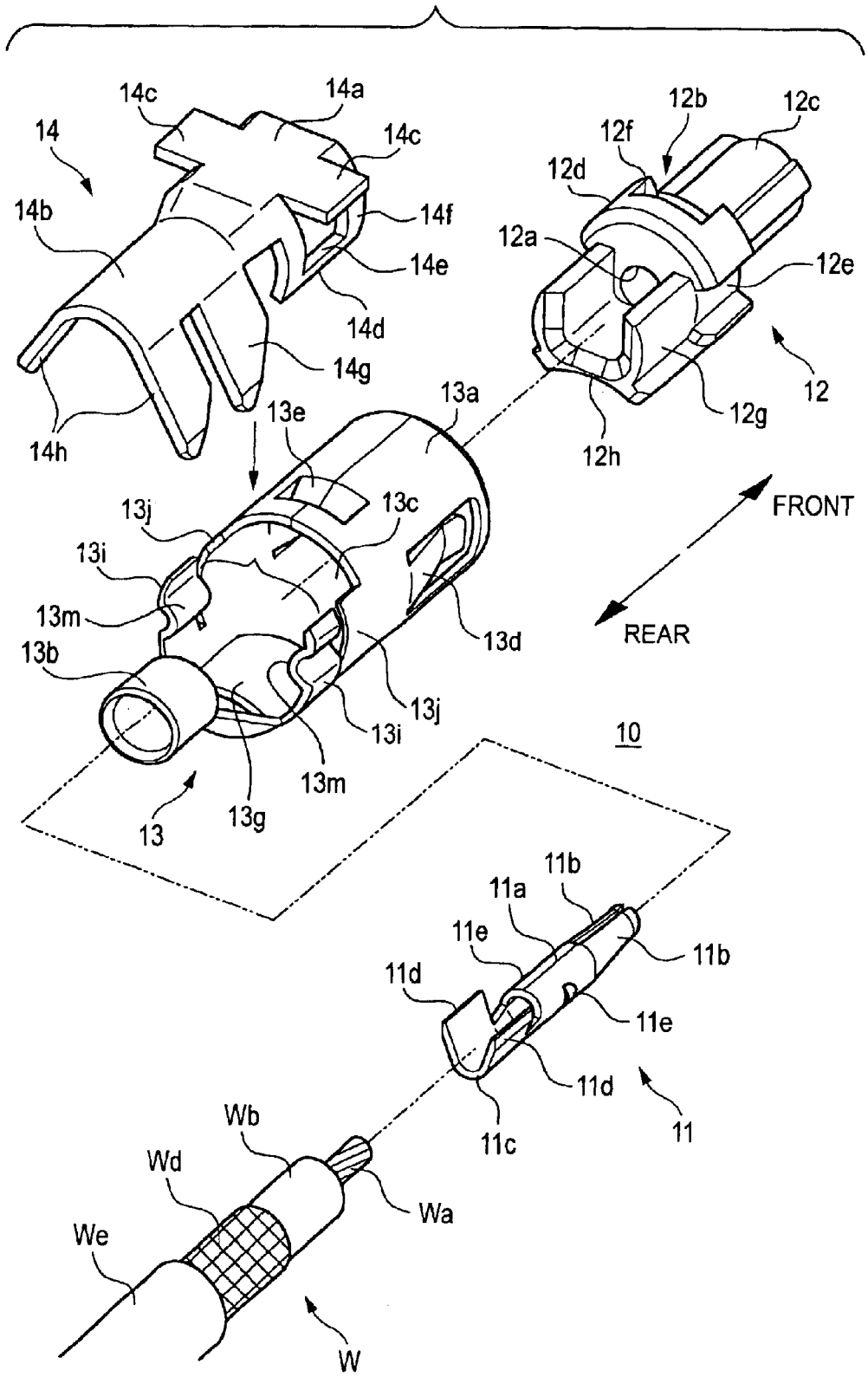
FIG. 2 is an exploded, perspective view of the coaxial connector as viewed from the rear side.
Figure 3:
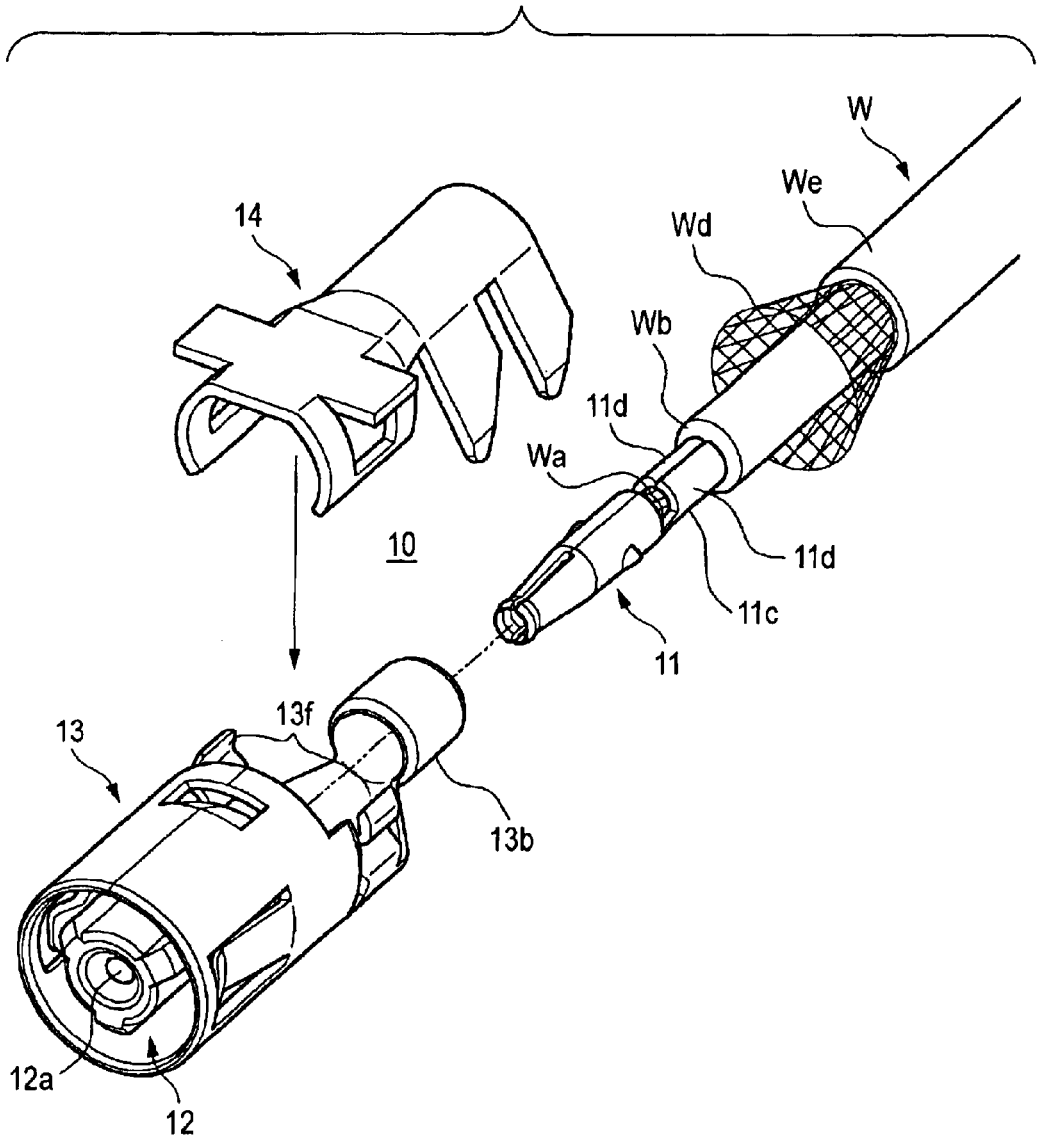
FIG. 3 is a view showing an outer conductor terminal, having a dielectric member beforehand received therein, an inner conductor terminal press-fastened to a signal conductor of a coaxial cable, and a shielding member to be attached to the outer conductor terminal.
Figure 4:
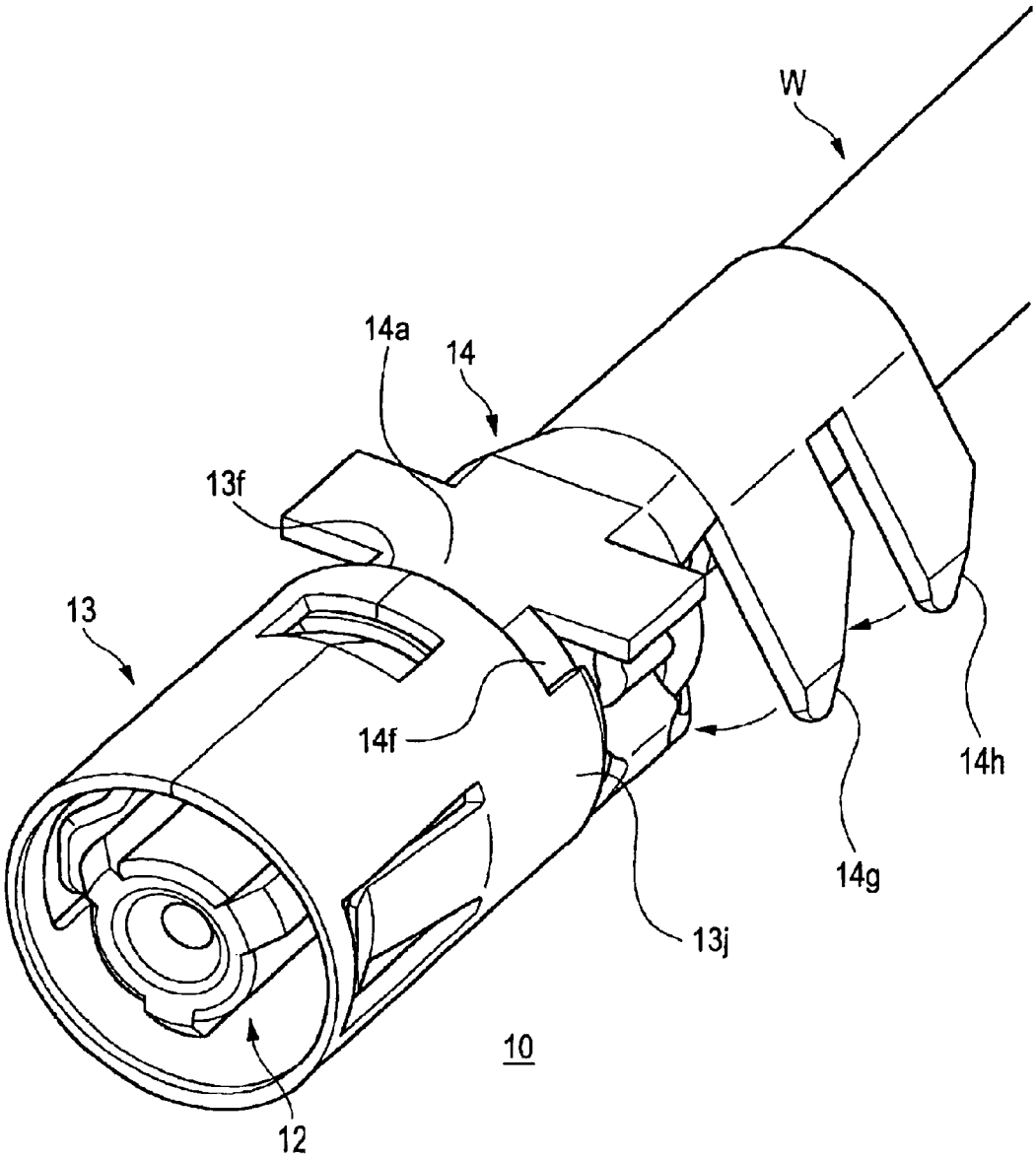
FIG. 4 is a view showing a condition before a press-clamping portion of the shielding member is press-fastened.
Figure 5:
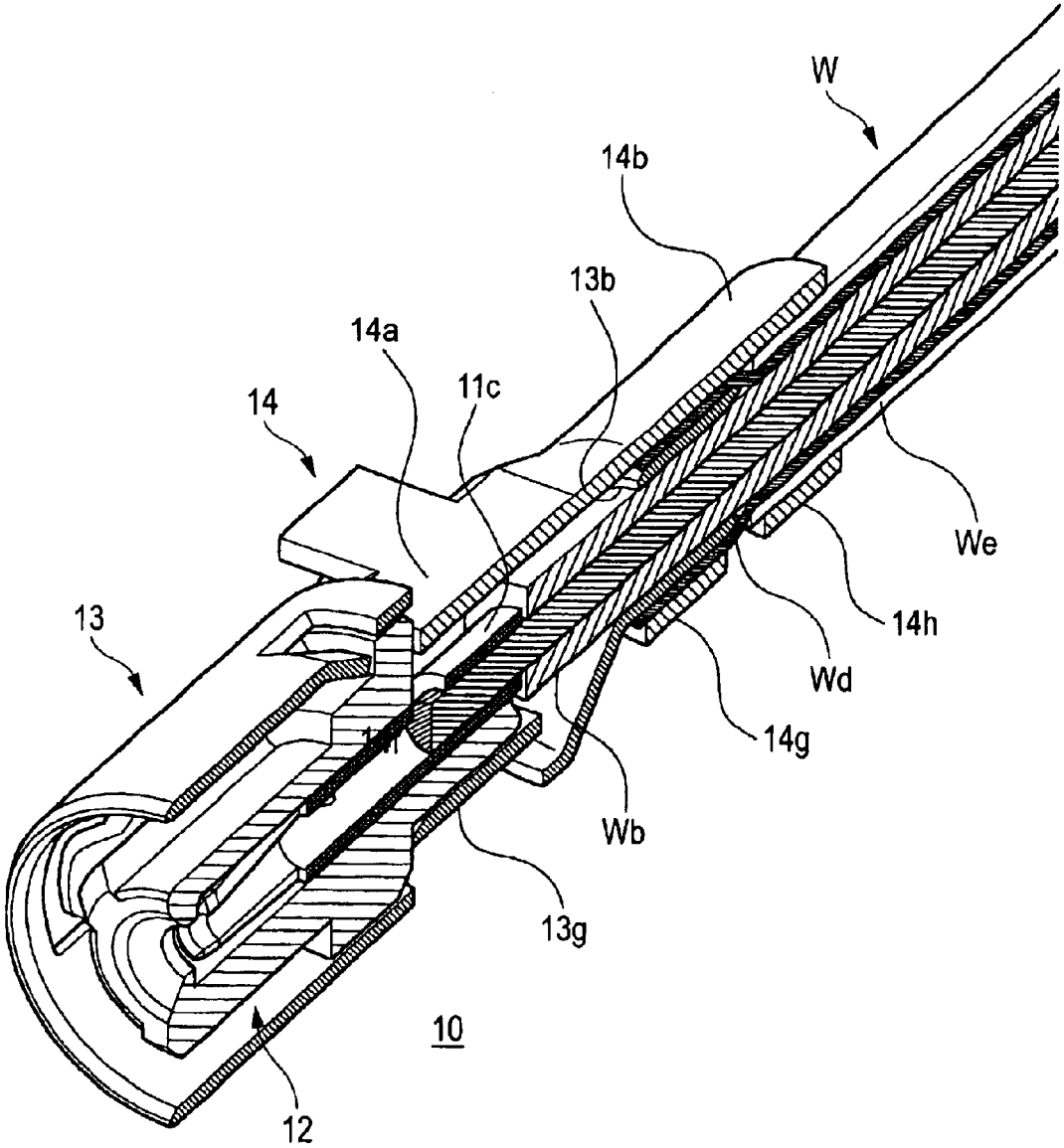
FIG. 5 is a vertical cross-sectional, perspective view of the coaxial connector, showing a condition in which the mounting operation is completed.
Figure 6:
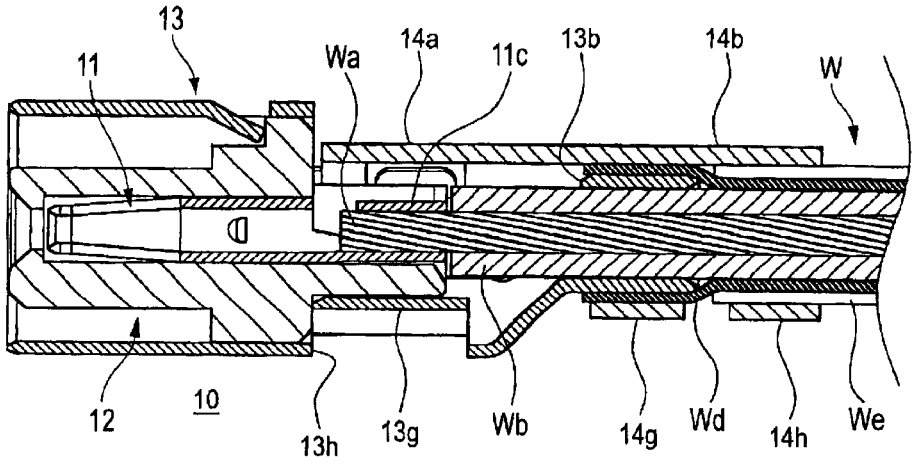
FIG. 6 is a vertical cross-sectional view of the coaxial connector, showing a condition in which the mounting operation is completed.

One embodiment of a coaxial connector of the present invention will now be described in detail with reference to the drawings. FIGS. 1 and 2 are exploded perspective views of the coaxial connector as viewed from front side and rear side, respectively. FIGS. 3 and 4 are perspective views showing a process of connecting the coaxial connector to a coaxial cable. FIGS. 5 and 6 are a vertical cross-sectional perspective view and a vertical cross-sectional view of the coaxial connector after the connection is effected, respectively.

The coaxial connector 10, shown in FIGS. 1 and 2, includes an inner conductor terminal 11, a dielectric member 12, an outer conductor terminal 13, and a shielding member 14. The inner conductor terminal 11 is connected to a signal conductor Wa of the coaxial cable W. The dielectric member 12 receives the inner conductor terminal 11. The outer conductor terminal 13 receives the dielectric member 12. The shielding member 14 closes an opening portion 13*f* in the outer conductor terminal 13. A high-frequency signal is transmitted to the inner conductor terminal 11 connected to the signal conductor Wa of the coaxial cable W. The outer conductor terminal 13 and the shielding member 14 serve to cover the outer periphery of the inner conductor terminal 11 to electromagnetically shield the inner conductor terminal 11. The dielectric member 12 serves to insulate the inner and outer conductor terminals from each other.

Figure 10:
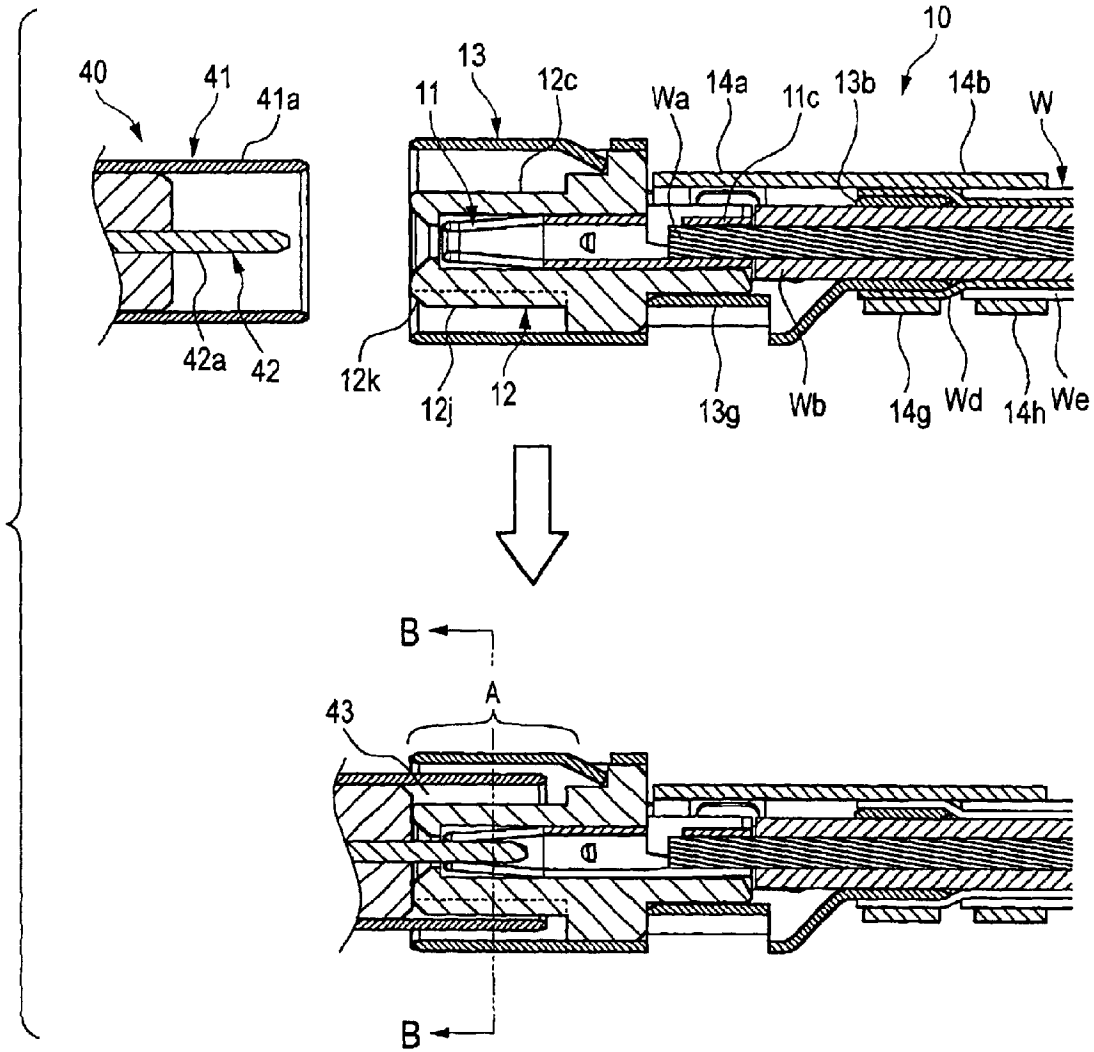
FIG. 10 is a view showing a fitting connection structure for a counterpart connector.

The inner conductor terminal 11 is formed by stamping out a piece from an electrically-conductive sheet and then by bending this piece into a substantially tubular shape by pressing or the like. This inner conductor terminal 11 is connected to an inner conductor terminal of a counterpart connector so as to transmit and receive an electrical signal. In this case, the inner conductor terminal 11 has a so-called female terminal shape and includes a tubular portion la having contact piece portions 11*b* and 11*b* of an arcuate shape separated from each other in a circumferential direction by longitudinal slits defined in a front end portion thereof. When a tab portion 42*a* of a male-type inner conductor terminal 42 of the counterpart male connector 40 as shown in FIG. 10 is inserted between the contact piece portions 11*b* and 11*b*, the contact piece portions 11*b* and 11*b* resiliently contact an outer surface of the tab portion 42*a* to connect thereto.

A press-clamping portion 11*c* for being press-fastened to the exposed signal conductor Wa of the coaxial cable W is provided at a rear side portion of the inner conductor terminal 11. A pair of press-clamping piece portions 11*d* and 11*d* formed at the press-clamping portion 11*c* are initially in an upwardly-open condition. The portions 11*d* and 11*d*, when press-fastened to the signal conductor Wa, are formed into a condition shown in FIG. 3. Projecting piece portions 11*e* and 11*e* are formed on and outwardly project from right and left side surfaces of the tubular portion 11*a*, respectively.

The dielectric member 12 into which the inner conductor terminal 11 is inserted is molded of an insulative resin material having a predetermined dielectric constant. The dielectric member 12 is disposed between the inner conductor terminal 11 and the outer conductor terminal 13 (described later) to insulate the conductor terminals 11, 13 from each other. An insertion hole 12*a* for receiving substantially the whole of the tubular portion 11*a* of the inner conductor terminal 11 is formed in a body portion 12*b* of the dielectric member 12 and opens forward and rearward. The body portion 12*b* includes a front side portion 12*c* and a flange portion 12*d*, which is larger in diameter than the front side portion 12*c* and is disposed in stepped relation thereto. Notches 12*e* and 12*e* are formed in right and left side surfaces of the flange portion 12*d*, respectively. When this dielectric member 12 is inserted into the outer conductor terminal 13 (described later), these notches 12*e* and 12*e* prevent the flange portion 12*d* from interfering with resilient contact piece portions 13*d* and 13*d* of the outer conductor terminal 13. Further, an engagement recess 12*f* is formed in an upper surface of the flange portion 12*d*. When this dielectric member 12 is inserted into the outer conductor terminal 13, an engagement piece portion 13*e* formed on an upper wall of the outer conductor terminal 13 is engaged with the engagement recess 12*f*.

A press-clamping-portion receiving portion 12*g*, which opens upwardly, extends rearwardly from the flange portion 12*d* of the body portion 12*b* and covers the right, left and lower sides of the press-clamping portion 11*c* of the inner conductor terminal 11 inserted in the insertion hole 12*a*.

When the inner conductor terminal 11 is inserted into the insertion hole 12*a* from the rear side of the dielectric member 12, the projecting piece portions 11*e* and 11*e* formed respectively on the right and left side surfaces of the tubular portion 11*a* are brought into biting engagement with an inner wall of the insertion hole 12*a*. As a result, the inner conductor terminal 11 is fixed to the dielectric member 12 and can not be easily withdrawn therefrom. At this time, the press-clamping portion 11*c* of the inner conductor terminal 11 is located within the press-clamping-portion receiving portion 12*g* of the dielectric member 12 so that the right, left and lower sides of the press-clamping portion 11*c* are covered with the press-clamping-portion receiving portion 12*g*. An avoidance recess 12*h* is formed in the lower sides of the flange portion 12*d* and press-clamping-portion receiving portion 12*g* of the dielectric member 12 to match with a shape of a matching convex wall 13*g*. The avoidance recess 12*h* serves to avoid interference with the matching convex wall 13*g* formed on a bottom wall of the outer conductor terminal 13 (see FIG. 2).

The outer conductor terminal 13 is formed by stamping out a piece from an electrically-conductive sheet and then by bending this piece by pressing or the like. The thus formed outer conductor terminal 13 includes a tubular body portion 13*a* and a sleeve portion 13. The tubular body portion 13*a* having a cylindrical shape and opening forward and rearward. The sleeve portion 13*b* having a cylindrical shape is smaller in diameter than the tubular body portion 13*a* and extends rearwardly from a lower portion of a rear end of the tubular body portion 13*a*.

The dielectric member 12 can be received in a receiving chamber 13*c* defined by the inner peripheral surface of the tubular body portion 13*a* of the outer conductor terminal 13. The resilient contact piece portions 13*d* and 13*d* are formed on right and left side walls of the tubular body portion 13*a*, respectively and are inwardly curved. When an outer conductor terminal 41 of the counterpart male connector 40 shown in FIG. 10 is fitted into, the tubular body portion 13*a*, the resilient contact piece portions 13*d* and 13*d* resiliently contact an outer surface of the outer conductor terminal 41. The engagement piece portion 13*e* for engaging with the engagement recess 12*f* formed in the upper surface of the flange portion 12*d* of the dielectric member 12 is formed on and projects inwardly from the upper surface thereof.

An opening portion 13*f* is formed at the rear side of the body portion 13*a* of the outer conductor terminal in which an upper wall portion thereof opens. As shown in FIG. 3, this opening portion 13*f* is used as an operation space when the inner conductor terminal 11 already press-fastened to the signal conductor Wa of the coaxial cable W is to be pushed into the insertion hole 12*a* in the dielectric member 12, which is fixedly received in the outer conductor terminal 13 in advance, from the rear side by a jig (not shown) or the like engaged with this inner conductor terminal. This opening portion makes it possible that a machine automatically inserts the inner conductor terminal. Therefore, after the inner conductor terminal 11 is inserted into the dielectric member 12, the press-clamping portion 11*c* of the inner conductor terminal 11 is exposed at this opening portion 13*f*.

Figure 8:
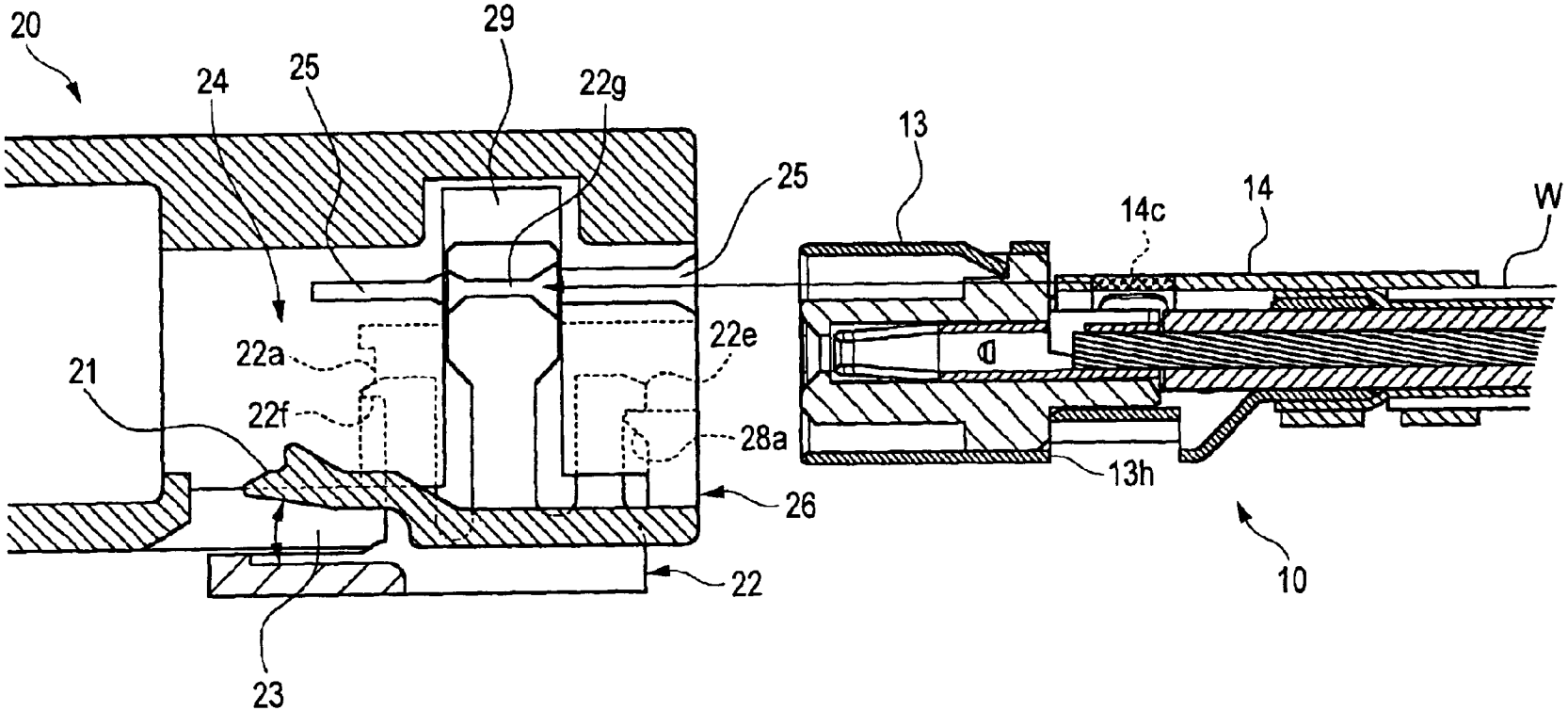
FIG. 8 is a view showing the manner of mounting the coaxial connector in the connector housing.

The matching convex wall 13*g* is formed on the bottom wall of the outer conductor terminal 13 located at a position of the opening portion 13*f*. This convex wall 13*g* is formed by a shearing process so as to bulge inwardly into an arcuate shape (see FIG. 2). This matching convex wall 13*g* is provided in order to decrease a high impedance of the press-clamping portion 11*c* located at the position of the opening portion 13*f* by reducing the cross-sectional area of that portion of the outer conductor terminal, thereby achieving the impedance matching. Incidentally, an opening portion 13*h* (a portion of the matching convex wall 13*g* as viewed from the outer side of the outer conductor terminal 13) is formed as a result of formation of the matching convex wall 13*g*. As shown in FIG. 8, the opening portion 13*h* is used to retain a lance 21 formed on a connector housing 20, when this coaxial connector 10 is inserted into the connector housing 20.

Engagement piece portions 13*i* and 13I, which is resiliently-deformable and inwardly curved, are formed at the right and left side walls of the outer conductor terminal located at the position of the opening portion 13*f*, respectively. These engagement piece portions 13*i* and 13*i* are used when attaching the shielding member 14 (described later) in a manner to close the opening portion 13*f*. Further, guide portions 13*j* and 13*j* for guiding the shielding member 14 at a time of attaching the shielding member 14 are formed a little forwardly than the engagement piece portions 13*i* and 13*i*. The guide portions 13*j* and 13*j* also function to prevent the shielding member 14 from being wrenched and deformed when attaching the shielding member 14.

The diameter of the cross-section of the sleeve portion 13*b* formed at the rear end of the outer conductor terminal 13 is substantially equal to or slightly larger than that of an insulator Wb of the coaxial cable W. As shown in FIG. 3, when this connector is connected to the coaxial cable W, a shielding conductor Wd of a braided wire covers on the sleeve portion 13*b* and the sleeve portion 13 is disposed between the insulator Wb and shielding conductor Wd of the coaxial cable. Braided press-clamping piece portions 14*g* and 14*g* of a press-clamping portion 14*b* of the shielding member 14 (described later) are caulked onto the sleeve portion 13*b* from above the sleeve portion 13*b* covered with the shielding conductor Wd. As a result the outer conductor terminal 13 and the shielding conductor Wd are connected to each other.

The shielding member 14 is formed by stamping out a piece from an electrically-conductive sheet and then by bending this piece by pressing or the like. The shielding member 14 includes a shielding portion 14*a* and the press-clamping portion 14*b* extending rearwardly from the shielding portion 14*a*. The shielding portion 14*a* serves to close the opening portion 13*f* of the outer conductor terminal 13. The press-clamping portion 14*b* serves to fix the connector 10 to the coaxial cable.

Stabilizers 14*c* and 14*c* are formed on and project rightward and leftward from the shielding portion 14*a* of the shielding member 14, respectively. The stabilizers 14*c* and 14*c* are used when inserting the coaxial connector 10 into the connector housing 20 as shown in FIG. 8. The stabilizers 14*c* and 14*c* are slid along guide grooves 25 formed in opposed side surfaces of a connector receiving chamber 24 of the connector housing 20, thereby preventing the erroneous insertion of the connector into the connector housing 20. When a retainer 22 is attached to the connector housing, the retainer 22 retains the stabilizers 14*c* and 14*c* to prevent the withdrawal of the connector from the connector housing 20. The lance 21 of the connector housing 20 and the retainer 22 jointly form a double-retaining structure for the coaxial connector 10, and this structure will be described later in detail.

As a result of formation of the stabilizers 14*c* and 14*c*, openings 14*e* and 14*e* are formed respectively in engagement portions 14*d* and 14*d*, which are bent downwardly and extend from right and left sides of the shielding portion 14*a*, respectively. When attaching this shielding member 14, projected portions 13*m* and 13*m* of the engagement piece portions 13*i* and 13*i* provided on the right and left sides of the opening portion 13*f* of the outer conductor terminal 13 are fitted into the openings 14*e* and 14*e*. During the attaching operation, front end portions 14*f* and 14*f* of the openings 14*e* and 14*e* are guided by the guide portions 13*j* and 13*j* of the outer conductor terminal 13, thereby preventing the shielding member 14 from being wrenched and deformed when attaching it. When this shielding member 14 is attached to the outer conductor terminal 13, the opening portion 13*f* of the outer conductor terminal 13 is closed while the shielding member 14 and the outer conductor terminal 13 are electrically connected together.

The pair of braid press-clamping piece portions 14*g* and 14*g* and a pair of sheath press-clamping piece portions 14*h* and 14*h* (disposed rearwardly of these portions 14*g* and 14*g*) are formed on the press-clamping portion 14*b* of the shielding member 14. These press-clamping portions are initially in a downwardly-open condition. The front braid press-clamping piece portions 14*g* and 14*g* are press-fastened onto the sleeve portion 13*b* of the outer conductor terminal 13. In this case, these press-clamping piece portions are press-fastened on the sleeve portion 13*b* in such a manner that the sleeve portion 13*b* is covered with the shielding conductor Wd. As a result, the shielding conductor Wd of the coaxial cable W and the outer conductor terminal 13 are electrically connected together, and this connection is made firm. The rear sheath press-clamping piece portions 14*h* and 14*h* are press-fastened onto a sheath portion We at which the signal conductor Wa and the shielding conductor Wd are not exposed. These press-clamping portions 14*h* and 14*h* fix the shielding member 14 and the outer conductor terminal 13 to the coaxial cable W.

A position of the shielding portion 14*a* of the thus attached shielding member 14*a* in the opening portion 13*f* in the outer conductor terminal 13 is shown in FIGS. 4 and 5. More specifically, the position of this shielding portion 14*a* is disposed below the upper wall of the outer conductor terminal 13. As with the matching convex portion 13*g*, this configuration contributes to reduce the cross-sectional area of this portion of the outer conductor terminal 13 thereby decrease a high impedance of the press-clamping portion 11*c* of the inner conductor terminal 11. This configuration cooperates with the matching convex portion 13*g* to achieve the impedance matching.

A process of mounting the coaxial connector 10 of this construction on the coaxial cable W includes the following steps: i) exposing the signal conductor Wa and the shielding conductor Wd over a predetermined length by removing the sheath from an end portion of the coaxial cable W (at this time, the shielding conductor Wd may be spread into a generally horn-shape as shown in FIG. 3); ii) press-fastening the press-clamping portion 11*c* of the inner conductor terminal 11 to the signal conductor Wa; iii) inserting the inner conductor terminal 11 into the dielectric member 12, which is received in the outer conductor terminal 13 in advance, and simultaneously fitting the shielding conductor Wd on the sleeve portion 13*b*; and iv) attaching the shielding member 14 to the opening portion 13*f* of the outer conductor terminal 13 and simultaneously press-fastening the press-clamping portion 14*b* of the shielding member 14 on the sleeve portion 13*b* and the sheath We. These process steps are similar to those effected in the field of connectors according to the related art and can be automated by a machine. Therefore, this connector can be produced at a cost much lower than that of the coaxial connector according to the related art (described above in the "Background of the Invention") in which the mounting steps are carried out manually.

The constructions and mounting process of the coaxial connector 10 according to one preferred embodiment of the invention have been described above. Next, the functions of these constructions will be described in detail.

Generally, when a characteristic impedance of a coaxial cable for transmitting a high-frequency electrical signal does not coincide with an input impedance of each of circuits connected to opposite ends of the cable, the reflection of the signal occurs. This reflection causes noises and the transfer of energy is wasted. Therefore, the transmission circuit is designed to have the same impedance value at any point thereof. This is called the impedance matching. Usually, the impedance matching between a circuit board of an electrical equipment, a cable and so on is achieved by setting the impedance value, for example, to 50Ω. Naturally, the impedance of a coaxial connector used for connecting cables together or connecting a cable and a circuit board together must be matched. If even part of the coaxial connector is not matched in impedance with a transmission path, there are encountered disadvantages such as the lowered transmission efficiency due to the reflection of a signal at this mismatching portion, the production of noises, and the occurrence of crosstalk.

With respect to a characteristic impedance of a coaxial connector, generally, the impedance matching with a coaxial cable (serving as a transmission path) is accomplished by adjusting "the ratio of an inner diameter of a cross-section of an outer conductor terminal to an outer diameter of a cross-section of an inner conductor terminal" and "the dielectric constant of a dielectric member". However, the diameter of a cross-section of a press-fastened press-clamping portion of the inner conductor terminal is usually smaller than the diameter of a cross-section of its terminal portion, received in a dielectric member, since this press-clamping portion has such a size and shape as to give priority to the reliability of electrical connection between the inner conductor terminal and a signal conductor of the cable. On the other hand, in this range, the cross-sectional area of the tubular outer conductor terminal is constant, and therefore when the impedance of the front portion of the coaxial connector is made equal to that of the coaxial cable, the impedance of the press-clamping portion of the inner conductor terminal becomes higher than the impedance of the coaxial cable.

In order to improve this situation, there has heretofore been used a method of increasing the diameter of the press-fastened press-clamping portion of the inner conductor terminal to thereby achieve the impedance matching so as to even meet with the transmission of a signal of a higher frequency, and in such a method, the diameter of the press-fastened press-clamping portion has been increased by winding a metal tape on the press-fastened press-clamping portion in a separate step or by further press-fastening a tubular metal sleeve on the press-fastened press-clamping portion. However, the process of winding the metal tape on the press-clamping portion to increase the diameter thereof is carried out manually, and besides in the case of a small-size coaxial connector, this operation is carried out relative to a very thin press-fastened press-clamping portion of a small inner conductor terminal, and therefore this operation is very cumbersome, and the high processing precision is not obtained, and it is difficult to provide the low-cost product by reducing the time required for the connector-producing process. In addition, if the metal tape should be disengaged from the press-clamping portion, there is a fear that it comes into contact with the outer conductor terminal to cause short-circuiting, and therefore it has been difficult to use this method for the connector used in a severe environment.

With respect to the process of further press-fastening the tubular metal sleeve on the press-fastened press-clamping portion to increase the diameter thereof, the press-fastening of this sleeve can be carried out in an automated manner by a machine, and therefore the low-cost production seems to be achieved. However, the press-fastening of this metal sleeve is naturally carried out at the time of processing the end portion of the cable so as to connect this cable to the connector, and therefore an additional processing machine, specially designed for press-fastening the metal sleeve, need to be provided for each processing line at a cable end-processing factory, and this rather makes the cost higher.

In the coaxial connector 10 of this embodiment of the invention, the inwardly-bulging matching convex wall 13*g* is formed at the position of the bottom wall of the outer conductor terminal 13, where the press-clamping portion 11*c* of the inner conductor terminal 11 is located. As a result, the cross-sectional area of that portion of the outer conductor terminal 13 is reduced, thereby decreasing the high impedance at this region so as to achieve the impedance matching. Therefore, the above-mentioned operation for increasing the thickness (diameter) of the press-clamping portion can be omitted.

The opening portion 13*f* is provided at the position of the outer conductor terminal 13, where the press-clamping portion 11*c* of the inner conductor terminal 11 is located. The opening portion 13*f* is used as an operation space when the inner conductor terminal 11 is pushed into the insertion hole 12*a* in the dielectric member 12, which is fixedly received in the outer conductor terminal 13 in advance, by the jig or the like. The press-clamping portion 11*c* of the inner conductor terminal 11 exposed at this opening portion 13*f* is not entirely covered with the shielding-purpose outer conductor terminal 13 in all directions. The press-clamping portion 11*c* of the inner conductor terminal 11 is open to the ambient air having a dielectric constant ($\epsilon$=1). As a result, the shielding performance such as radiation characteristics is lowered. In the axial connector 10 of this invention, however, this opening portion 13*f* is closed by the shielding member 14. Therefore, such lowered performance is avoided. In addition, utilizing this opening portion 13*f*, the inner conductor terminal inserting operation can be carried out in an automated manner by a machine. Therefore, as compared with the coaxial connector according to the related art (described above in the "Background of the Invention"), which has been manually mounted on the cable, the time, required for mounting the connector on the coaxial cable, can be made shorter. The production cost and the price of the product can be reduced.

Furthermore, in the axial connector 10 of this embodiment of the invention, the shielding portion 14*a* of the attached shielding member 14 is disposed below the upper wall of the outer conductor terminal 13 as shown in FIGS. 4 to 6. As with the matching convex portion 13*g*, the cross-sectional area of this portion of the outer conductor terminal 13 is reduced so that a high impedance at this position can be decreased. As a result, this construction as well as the matching convex portion 13*g* has the function of achieving the impedance matching. Therefore, the impedance can be set by adjusting the amount of projection of the matching convex portion 13*g* and the position of the shielding portion 14*a* in the opening portion 13*f*. Therefore, the design for setting the impedance of the connector can be effected easily.

In the connector 10 according to this embodiment of the invention, the shielding conductor Wd is fitted on the sleeve portion 13*b* formed on the outer conductor terminal 13, and the braid press-clamping piece portions 14*g* and 14*g* formed on the shielding member 14 are press-fastened onto this shielding conductor, thereby connecting the outer conductor terminal 13 to the shielding conductor Wd. With this construction, the deformation of the cross-section of the axial cable W is prevented. Particularly in the case of the coaxial cable meeting with high-frequency transmission, the insulator Wb is usually made of a foamed resin. When the press-clamping portion is press-fastened directly on the shielding conductor, the cross-section of the cable is usually deformed and the characteristic impedance is disturbed by this cross-section deformation. However, this disadvantage is prevented by the sleeve portion 13*b*.

Thus, the press-clamping portion for clamping engagement with the cable, which has heretofore been formed integrally on the outer conductor terminal, is eliminated, and this portion is formed into the sleeve portion 13*b* for preventing the deformation of the cable, and instead the press-clamping portion 14*b* for clamping engagement with the cable is formed on the shielding member 14, and with this construction the process of mounting the connector on the cable can be carried out in an automated manner by a machine. Namely, the production cost, required for mounting the connector on the coaxial cable, can be reduced as compared with the conventional coaxial connector (described above in the Section "Prior Art") which has been manually mounted on the coaxial cable.

Figure 7:
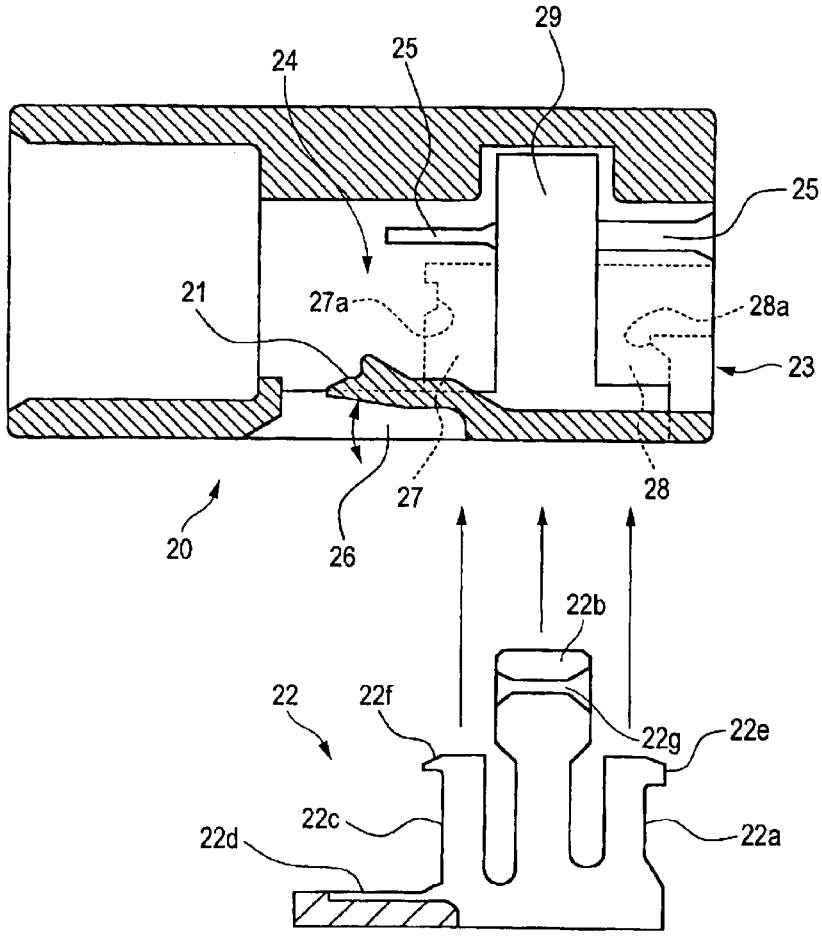
FIG. 7 is a view showing a connector housing for receiving the coaxial connector, and a retainer.
Figure 9:
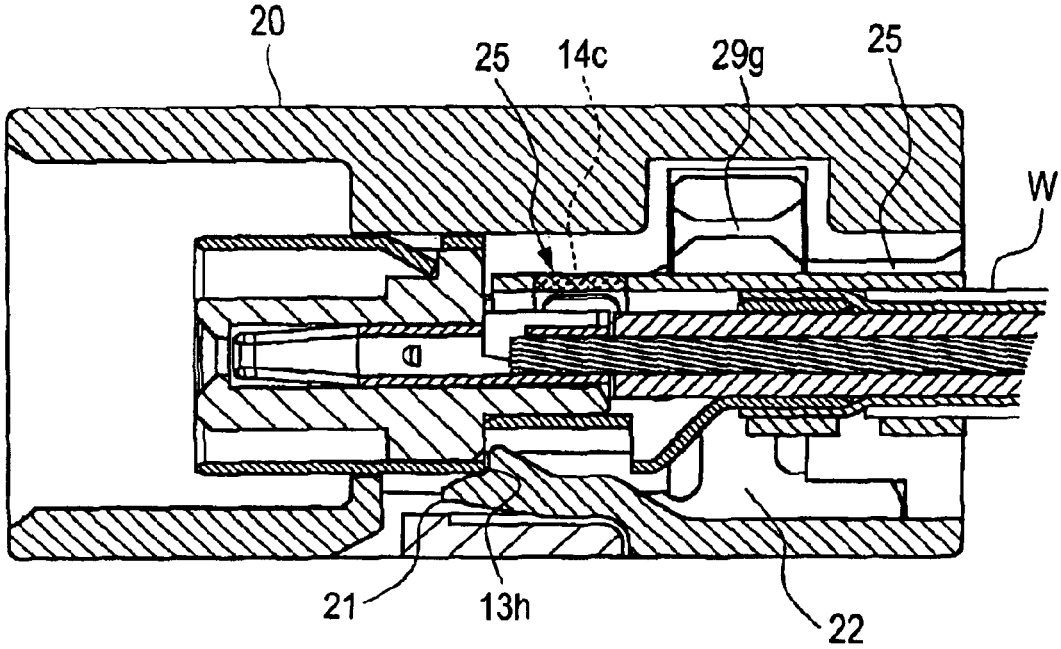
FIG. 9 is a view showing the coaxial connector received in the connector housing.

Next, the double-retaining of the coaxial connector 10 by the lance 21 and the retainer 22, which are formed at the connector housing 20, will be described with reference to FIGS. 7 to 9. As shown in FIG. 7, the connector housing 20 is formed into an integral construction of a generally tubular shape using a synthetic resin material. The coaxial connector 10 is inserted into this connector housing 20 through a connector insertion port 23, and is received in the connector receiving chamber 24.

The lance 21 is formed on a lower side of an inner surface of the connector receiving chamber 24, projects inwardly, and extends from a rear side toward a front side. The lance 21 is elastically deformable upward and downward, and engages the front end of the opening portion 13*h*, which formed as a result of formation of the matching convex wall 13*g* on the outer conductor terminal 13 of the coaxial connector 10 adapted to be received in the connector housing 20, thereby preventing the withdrawal of the connector 10. On the inner surface defining the connector receiving chamber 24, the guide grooves 25 are concavely defined at positions of right and left side portions, which are opposed to the lance 21. The stabilizers 14*c* of the shielding member 14 can be inserted into these guide grooves 25.

A retainer attaching hole 26 communicating with the connector receiving chamber 24 is formed on a side of the connector housing 20 having the lance 21. Two engagement projections 27*a*, 28*a* are projectedly formed in each of retainer engagement grooves 27 and 28 communicating with the retainer attaching hole 26. The rear projection 28*a* serves as a provisionally-engaging projection. The provisionally-engaging projection 28*a* can engage a corresponding provisionally-engaging leg portion 22*a* of the retainer 22 to hold the retainer 22 in a provisionally-engaged position. The front projection 27*a* serves as a completely-engaging projection and is disposed at a deeper position than the provisionally-engaging projection 28*a*. This completely-engaging projection 27*a* can engage a corresponding completely-engaging leg portion 22*c* of the lance 22 to hold the lance in a completely-engaged position. A connector engagement groove 29 communicating with the guide grooves 25 of the connector receiving chamber 24 is formed between the retainer engagement grooves 27 and 28. A central leg portion 22*b* of the retainer 22 can enter the connector engagement groove 29.

The retainer 22 is formed into an integral construction using a synthetic resin, and is attached to the connector housing 20 to retain the coaxial connector 10 against withdrawal. The retainer 22 includes a base portion 22*d* of a flattened shape, the engaging leg portions 22*a* and 22*c* and the central leg portion 22*b* extending upwardly from this base portion 22*d*, the central leg portion 22*b* being disposed between the two engaging leg portions. The base portion 22*d* can be received in the retainer attaching hole 26 of the connector housing 20 in such a manner that the base portion 22*d* covers the outer side of the lance 21 in contiguous relation thereto.

The engaging leg portions 22*a* and 22*c* of the retainer 22 can be elastically deformed toward each other. Engagement claws 22*e* and 22*f* are formed on distal ends of the leg portions 22*a* and 22*c*, respectively, and can be engaged respectively with the engaging projections 27*a* and 28 formed on the inner surfaces of the retainer engagement grooves 27 and 28.

The central leg portion 22*b* extends longer than the engaging leg portions 22*a* and 22*c*, and can be exposed to the guide groove 25 through the connector engagement groove 29. An interference prevention groove 22*g* is formed in a distal end portion of the central leg portion 22*b*. The width of this interference prevention groove 22*g* is substantially equal to the width of the guide groove 25. When the retainer 22 is disposed in the provisionally-retained position, the interference prevention groove 22*g* coincides with the corresponding guide groove 25. At this time, the retainer 22 does not restrain forward and rearward movement of the stabilizers 14*c* formed on the shielding member 14 of the coaxial connector 10. Therefore, the coaxial connector 10 is allowed to be inserted into and withdrawn from the connector receiving chamber 24 (see FIG. 8). When the retainer 22 is further inserted into the completely-engaged position, the interference prevention groove 22*g* is disposed deeper beyond the guide groove 25. Therefore, the guide groove 25 is closed at an intermediate position, thereby restraining the forward and rearward movement of the stabilizer 14*c* (see FIG. 9).

Thus, the lance 21 provided within the connector receiving chamber 24 retains the outer conductor terminal 13 of the coaxial connector 10, and the retainer 22 inserted through the retainer attaching hole 26 retains the stabilizers 14*c* of the shielding member 14 of the coaxial connector 10. With this double-retaining structure, when the coaxial cable W is pulled hard, the stabilizers 14*c* of the shielding member 14 bear this external force. Therefore, the coaxial cable W and the shielding member 14 are more positively prevented from being withdrawn with the outer conductor terminal 13 remaining in the connector housing 20. In addition, the double-retaining structures are provided at positions opposed to each other in the connector receiving chamber 24 of the connector housing 20. Therefore, as compared with a case where the double-retaining structures are provided at one side, the coaxial connector 10, when pulled, is more effectively prevented from being wrenched within the connector housing, and therefore is prevented from damage.

Figure 11:
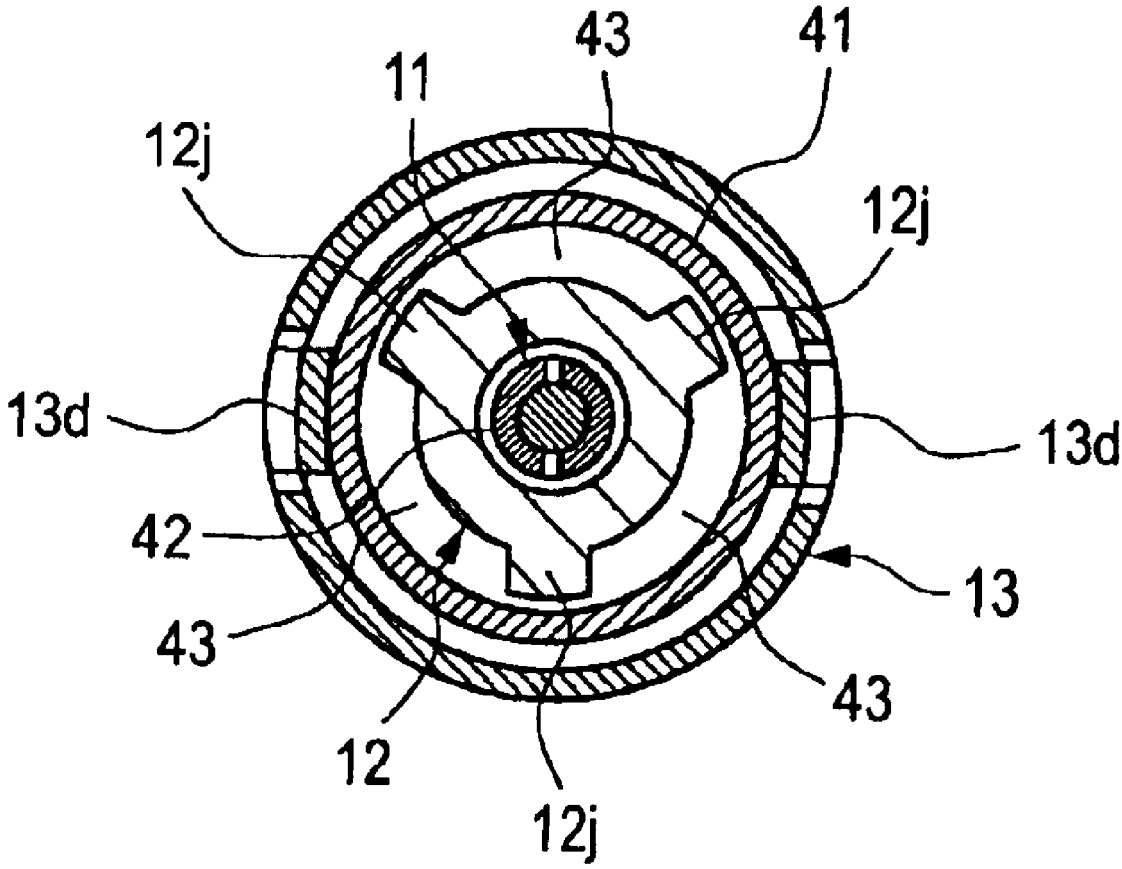
FIG. 11 is a view showing the cross-section through a portion at which the coaxial connector and the mating connected are fitted together.

Next, the structure of connecting the coaxial connector 10 and the counterpart connector together will be described with reference to FIGS. 10 and 11. As shown in FIG. 10, the outer conductor terminal 41 of the male connector 40, which is adapted to be fittingly connected to the coaxial connector 10, can be fitted into the outer conductor terminal 13 of the coaxial connector 10. Similarly, the inner conductor terminal 42 can be fitted into the inner conductor terminal 11 of the coaxial connector 10. FIG. 11 is a cross-sectional view showing a fitting portion A of the connection structure at a position B.

As shown in the drawings, at the fitting portion A, the female-type inner conductor terminal 11 of the coaxial connector 10 is received in the male-type outer conductor terminal 41 having a small inner diameter. Therefore, an impedance at this portion is low. However, an air layer 43 is interposed between a tubular portion 41*a* of the male-type outer conductor terminal 41 and the dielectric member 12 to decrease an effective value of a dielectric constant, and by doing so, the impedance matching is achieved even at this fitting portion A.

In this case, three ribs 12*j*, extending in the longitudinal direction, are formed on the outer surface of the front side portion 12*c* of the dielectric member 12 to increase the strength of the front side portion 12*c*, and besides the outer diameter of the front side portion 12*c*, including the ribs 12*j*, is made generally equal to the inner diameter of the male-type outer conductor terminal 41, and with this construction a centering function is enhanced during the fitting connection, and the good fitting connection can be achieved. In this case, a tapering surface 12*k* is formed at the distal end of the front side portion 12*c* of the dielectric member 12, and extends to cover the front ends of the jibs 12*j*, and therefore the fitting connection to the counterpart connector can be carried out easily.

As described above, in the above structure, the mismatching due to the decrease of the impedance, caused by the difference in outer diameter between the outer conductor terminals, as well as the mismatching due to the high impedance in the vicinity of the press-clamping portion 11*c* in the opening portion 13*f*, is overcome, and therefore the impedance matching is precisely achieved throughout the whole of the connector.

The present invention is not limited to the above embodiment, and various embodiments of the invention can be made without departing from the scope of the invention. For example, in the above embodiment, although the convex wall has an arcuate shape, it can have any other suitable shape. In short, the convex wall of any shape can be used in so far as it decreases the impedance so as to achieve the impedance matching, and this convex wall is not limited to the illustrated shape of the above embodiment. And besides, although the above embodiment is directed to the round coaxial connector, the invention can be applied also to a coaxial connector of a square or polygonal coaxial connector.

In the coaxial connector of the present invention, when the inner conductor terminal, connected to the signal conductor of the coaxial cable, is mounted in the dielectric member, beforehand received in the outer conductor terminal, by utilizing the upwardly-open space (opening portion) in the outer conductor terminal, the connecting portion of the inner conductor terminal, connected to the signal conductor, is exposed in the opening portion. The convex wall is formed on the inner bottom surface of the opening portion to decrease the inner diameter of the opening portion toward the connecting portion, thereby matching the characteristic impedance of the connector also in the vicinity of the connecting portion. With this construction, a high impedance (which has heretofore developed since the connecting portion is open to the exterior through the opening portion) in the vicinity of the connecting portion of the inner conductor terminal, connected to the signal conductor, is decreased, thereby overcoming the impedance mismatching. And besides, this opening portion is closed by the shielding member, and therefore the shielding performance is not lowered, so that there can be provided the axial connector having excellent high-frequency characteristics. Furthermore, the process of mounting this connector on the coaxial cable can be easily effected in an automated manner by a machine.

What is claimed is:

1. A coaxial connector for a coaxial cable having a signal conductor, a shielding conductor, an insulator disposed between the signal conductor and the shielding conductor, and a sheath covering an outer periphery thereof, the coaxial connector comprising:

an inner conductor terminal connected to the signal conductor;

a dielectric member;

an outer conductor terminal of a cylinder shape, for receiving the inner conductor terminal through the dielectric member, the outer conductor terminal connected to the shielding conductor; and a shielding member;

wherein the outer conductor terminal includes:

a first opening;

a side wall; and a convex wall formed at a position opposed to a connection portion between the exposed signal conductor and the inner conductor terminal, to project toward inside thereof; and wherein the shielding member is attached to the outer conductor terminal to close the first opening.

2. The coaxial connector according to claim 1, wherein a sectional area of the first opening closed by the shielding member is smaller than that of other portion of the outer conductor terminal.

3. The coaxial connector according to claim 1, wherein the convex wall is formed to reduce a sectional area of the first opening.

4. The coaxial connector according to claim 1, wherein the shielding member is attached at a position on the outer conductor terminal to reduce a sectional area of the first opening.

5. The coaxial connector according to claim 1, wherein the shielding member is attached to the outer conductor terminal to engage with the side wall of the first opening.

6. The coaxial connector according to claim 1, wherein the outer conductor terminal further integrally includes a sleeve for covering the shield conductor of the coaxial cable; and wherein the shielding member includes a press-clamping portion, which is press-fixed to a portion of the sleeve, which the shielding conductor covers.

7. The coaxial connector according to claim 1, further comprising a connector housing, wherein the shielding member includes a stabilizer serving as a guide when the connector housing is attached.

8. The coaxial connector according to claim 1, wherein the shielding member includes a stabilizer protruding therefrom outwardly.

9. The coaxial connector according to claim 1, further comprising a connector housing including a retainer, wherein the shielding member includes a stabilizer for engaging with the retainer.

10. The coaxial connector according to claim 1, further comprising a connector housing including a lance for engaging with a second opening formed by protruding the convex wall.

11. A coaxial connector for a coaxial cable having a signal conductor, a shielding conductor, an insulator disposed between the signal conductor and the shielding conductor, and a sheath covering an outer periphery thereof, the coaxial connector comprising:

a first connector including an inner conductor terminal of a female terminal shape, for connected to the signal conductor;

an dielectric member;

an outer conductor terminal of a cylinder shape, for receiving the inner conductor terminal through the dielectric member, the outer conductor terminal connected to the shielding conductor; and a shielding member; and a second connector including:

an inner conductor terminal of a male terminal shape, the inner conductor terminal connected to the inner conductor terminal of the first connector; and an outer conductor terminal, wherein the outer conductor terminal of the first connector includes:

an opening;

a side wall; and a convex wall formed at a position opposed to a connection portion between the exposed signal conductor and the inner conductor terminal, to project toward inside thereof;

wherein the shielding member of the first connector is attached to the outer conductor terminal of the first connector to close the opening of the first connector;

wherein an end portion of the dielectric member of the first connector has smaller diameter than an end portion of the outer conductor terminal of the second connector; and wherein an air layer is defined between the dielectric member of the first connector and the outer conductor terminal of the second connector when the first and second connectors are connected to each other.

12. The coaxial connector according to claim 11, wherein a rib extending in a longitudinal direction is formed on the dielectric member of the first connector.

13. The coaxial connector according to claim 11, wherein a guide surface of a tapered shape is formed on the end portion of the dielectric member of the first connector.

* * * * *